United States Patent [19]

Chemello et al.

[11] Patent Number: 4,765,070

[45] Date of Patent: Aug. 23, 1988

[54] SKI BOOT WITH ADJUSTABLE INNER SOLE

[75] Inventors: Jean-Pierre Chemello, Annecy Le Vieux; Michel Mabboux, Seynod, both of France

[73] Assignee: Salomon S. A., Annecy, France

[21] Appl. No.: 933,947

[22] Filed: Nov. 24, 1986

[30] Foreign Application Priority Data

Nov. 22, 1985. [FR] France ..... 85 17288

[51] Int. Cl.[4] ..... A43B 5/04; A43B 13/14; A43B 7/16; A43B 7/28

[52] U.S. Cl. ..... 36/117; 36/91; 36/119

[58] Field of Search ..... 36/117–121, 36/81, 91; 128/598, 597, 596; 248/188.2

[56] References Cited

U.S. PATENT DOCUMENTS

| | | | |
|---|---|---|---|
| 2,352,170 | 6/1944 | Anderson | 128/598 |
| 2,463,754 | 3/1949 | Deters | 248/188.2 |
| 3,828,448 | 8/1974 | Leonildo | 36/119 |
| 3,922,800 | 12/1975 | Miller et al. | 36/47 |
| 4,314,411 | 2/1982 | Hanson | 36/117 X |
| 4,317,295 | 3/1982 | Hanson | 36/117 |
| 4,523,395 | 6/1985 | Borsoi | 36/119 |

FOREIGN PATENT DOCUMENTS

| | | | |
|---|---|---|---|
| 506261 | 6/1971 | Canada | 36/47 |
| 0073991 | 3/1983 | European Pat. Off. . | |
| 2953208 | 9/1980 | Fed. Rep. of Germany | 36/119 |
| 2086994 | 12/1971 | France | 36/119 |

*Primary Examiner*—James Kee Chi

*Attorney, Agent, or Firm*—Pollock, Vande Sande & Priddy

[57] ABSTRACT

Ski boot of the type comprising an inserted inner sole (2) resting on the actual boot sole (3) through the intermediary of at least two pairs of chocks respectively located at the front and the rear of the boot. Each chock is attached to the lower face of the inner sole by an attachment enabling it to be emplaced or removed by simple 90° rotation of the chock about an axis perpendicular to the inner sole.

13 Claims, 5 Drawing Sheets

SKI BOOT WITH ADJUSTABLE INNER SOLE

FIELD OF THE INVENTION

The present invention relates to a ski boot provided with an inner sole comprising means enabling both the longitudinal and lateral inclination of the sole to be changed at will.

BACKGROUND OF THE INVENTION

U.S. Pat. No. 4,144,659 discloses a boot at the interior of which is disposed an inner sole whose heel is provided with a support constituted by a lug placed at the center of the heel. This arrangement makes it possible to change at will the height of the heel with respect to the plantar region of the foot, and permits a slight pivoting movement of the foot at the interior of the boot, such that the weight of the skier is brought to bear on the inner or outer edge, according to the direction he wishes to take. The result of this arrangement is an amount of play of the foot inside the ski boot which is absolutely unacceptable.

U.S. Pat. No. 2,183,197 discloses a boot for normal walking which is provided with an inner sole, solid with the boot, provided on its lower face with plates connected to screws placed in threaded holes passing through the outer sole. It is thus possible, by turning the screws, to modify the camber of the sole, raising the plantar arch. Swiss Pat. No. 506,261 discloses an analogous arrangement, more particularly adapted to ski boots, comprising two plates respectively located in the plantar and heel regions of the foot, these plates also being connected to screws traversing the inner sole. Each plate comprises a plurality of screws disposed at its periphery such that it is possible simultaneously to raise the inner sole to a greater or lesser extent, and to change its inclination by means of the peripheral screws. This arrangement has the disadvantage of rather complex operation as regards the adjustment of lateral inclination. Both the U.S. and Swiss patents utilize screws traversing the outer sole and regulated through the exterior by means of a turn-screw; this is not convenient. Moreover, the orifices may be blocked by snow, ice or soil.

U.S. Pat. No. 3,922,800 discloses a ski boot comprising an inserted inner sole, comprising four adjustable chocks arranged in pairs, one pair at the level of the heel and one pair at the level of the plantar region of the foot. These chocks have asymmetrical profiles, such that both the longitudinal and lateral inclinations can be varied. However, these chocks are carried by transverse axles actuated by turn-screws, such that their placement into operation is delicate and complex. Moreover, these mechanisms are subject to being blocked by snow, ice or corrosion.

SUMMARY OF THE INVENTION

The present invention concerns a ski boot comprising an inner sole provided with four chocks enabling modification of the longitudinal or lateral inclination of said inner sole with respect to the boot, these chocks being placed into operation by means located on the lower face of the sole, i.e., inside the boot, and consequently protected from corrosion and inclement weather.

These chocks are solid with a cylindrical element which engages in a corresponding cylindrical aperture in the sole, each cylindrical element being provided at its end with a transverse bar which passes through a window of corresponding shape arranged on each side of said aperture, such that when the element is completely inserted in its aperture, it suffices to pivot it through 90° for the bar to be disengaged from the window and to block the element in position. It is thus possible, by a very simple procedure, to emplace or remove the chock.

Preferably, the sole comprises a plurality of apertures provided with elongated windows, such that chocks can be placed at any desired location.

According to a first embodiment of the invention, each chock is solid with a knob of greater diameter, unitary with the cylindrical element.

According to a second embodiment, each chock is constituted by a small plate solid with said cylindrical element, this plate being itself flexibly connected to a substantially rectangular small plate of predetermined thickness. On the sides of the aperture receiving the cylindrical element, there is on the one hand a plane, widened section standing out from the lower face of the sole, and on the other hand a recess, such that the small plate can, upon rotation of the cylindrical element by 180°, either come into abutment against the widened portion or into inserted position in the recess.

According to a third embodiment, the rear portion of the sole comprises four apertures capable of receiving chocks constituted by knobs, while the forward part of the sole comprises two apertures capable of receiving chocks constituted by small plates.

DESCRIPTION OF THE DRAWINGS

In order that the invention may be more clearly understood, reference will now be made to the accompanying drawings, wherein several embodiments of the invention are shown for purposes of illustration, and wherein.

DETAILED DESCRIPTION

Figure 1:
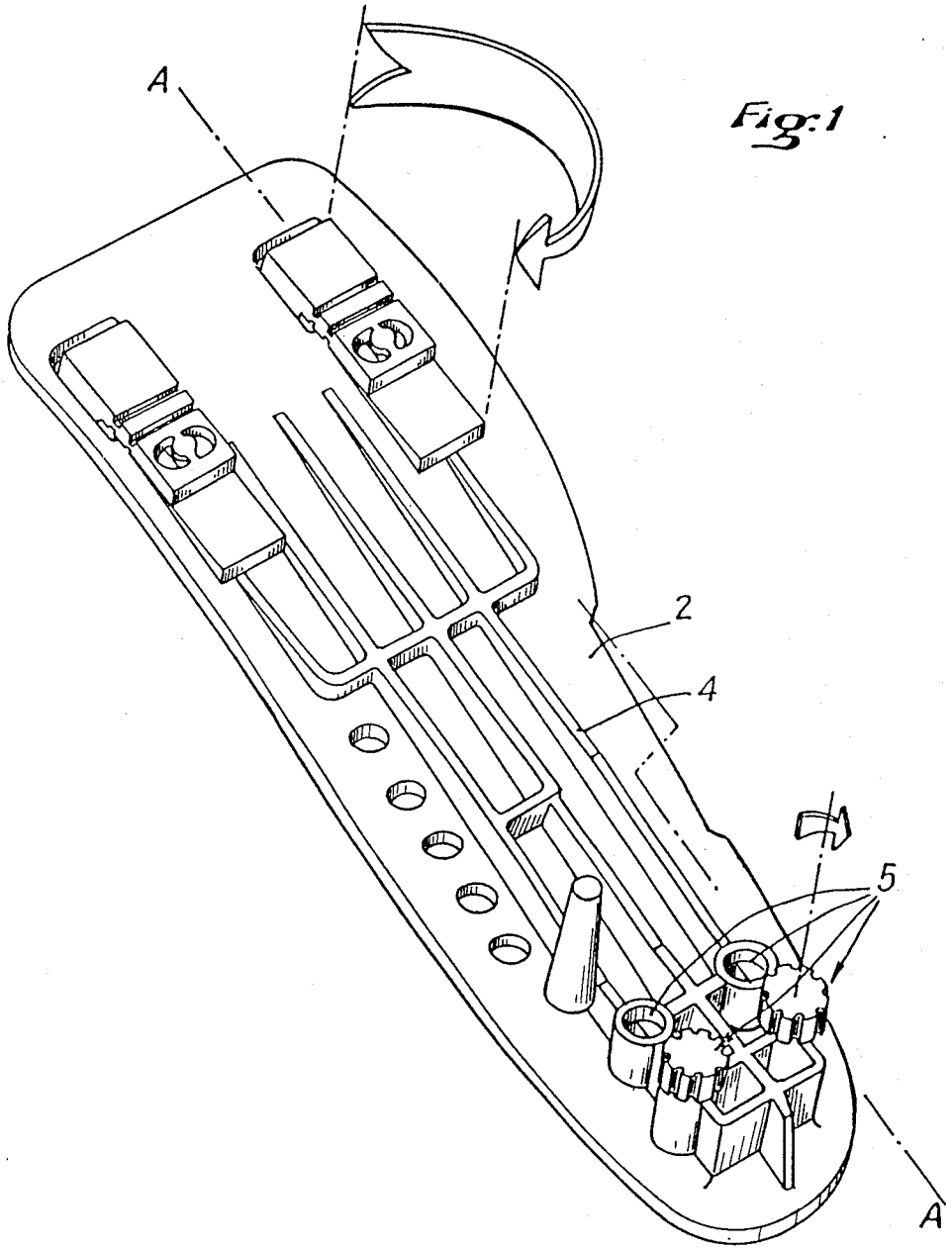
FIG. 1 is a perspective bottom view of the third embodiment of the invention.
Figure 2:
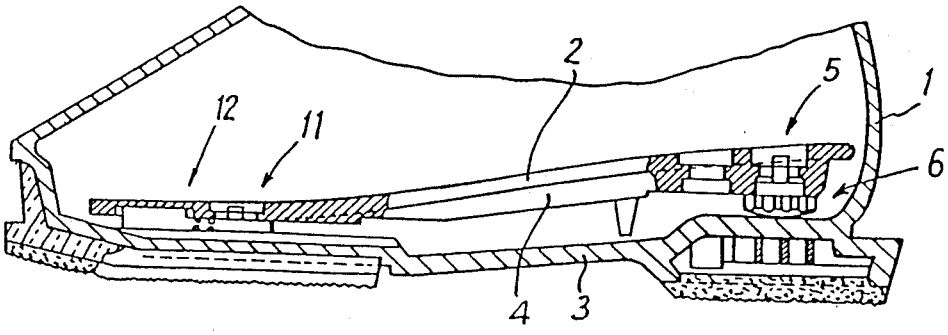
FIG. 2 is a side view, in section, along line A—A of FIG. 1.

As shown in FIG. 2, boot 1 is provided with an inner sole 2 which is placed at the interior of the boot and which rests on the upper surface of the bottom of the shell base constituting the actual boot sole 3. The latter sole is an integral part of the boot, while inner sole 2 is removable.

The inner sole has a configuration conforming approximately to the profile of sole 3, and comprises a certain number of stiffening ribs 4.

Figure 3:
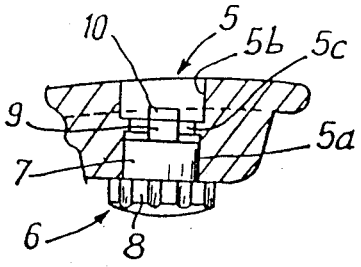
FIG. 3 is a detail view, in section, showing the rear chock.

In the region corresponding to the heel, sole 2 comprises four bores 5 located in two transverse pairs. As shown in FIGS. 2 and 3, each bore 5 is constituted by a lower cylindrical portion 5*a* and an upper cylindrical portion 5*b* connected to one another by an elongated window 5*c*. Chock 6 is constituted by a cylindrical element 7 whose axis is perpendicular to the surface of sole 2, and which is solid with a knurled knob 8 of greater diameter. Element 7 is solid with a short, coaxial cylindrical rod 9 having a diameter smaller than element 7 and equal to the width of elongated window 5*c*. This rod is solid at its end with a bar 10 having a shape corresponding to that of window 5*c*. In order to emplace chock 6, bar 10 is aligned with window 5*c* so that it can traverse it. The chock is then pivoted through 90° about its axis, which is perpendicular to the surface of sole 2, such that bar 10 rests on the bottom of aperture 5*b* and blocks chock 6 in position.

It is thus possible to emplace or withdraw chock 6 very easily. Since there is a plurality of bores 5, any desired number of chocks can be emplaced. Preferably, as shown, there are four bores 5 for two chocks 6, and FIGS. 7 to 10 show the various possible combinations.

In the plantar region of the foot, sole 2 comprises two bores 11, constituted by an upper cylindrical aperture 11*b* communicating with an elongated window 11*c*. Chock 12 is constituted by an attachment plate 13 coiled with a cylindrical rod 14 whose axis is perpendicular to sole 2, this rod being provided at its end with a bar having a shape corresponding to that of window 11*c*. In order to emplace chock 12, bar 15 is so aligned that it traverses window 11*c*, and the chock is then pivoted 90° about an axis perpendicular to sole 2, such that bar 15 rests against the bottom of aperture 11*b* and thus blocks chock 12 in position. A substantially rectangular small plate 17 with a diameter e is articulated to attachment plate 13 by any desired means, e.g., a plastic tongue 16. On either side of bore 11, the lower face of sole 2 comprises a plane widened portion 18 and a recess 19 having a shape corresponding to that of small plate 17.

Figure 5:
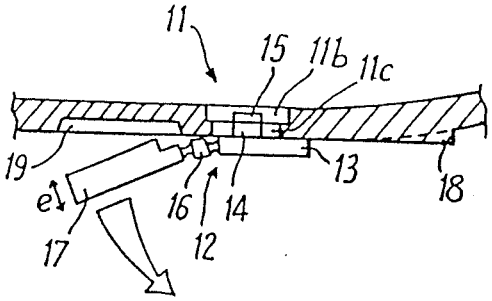
FIG. 5 is a detail view showing the front chock in a first position.
Figure 6:
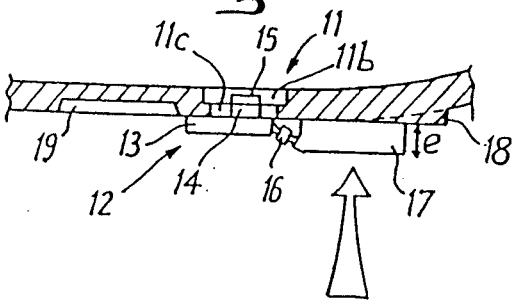
FIG. 6 is a view corresponding to FIG. 5, showing the front chock in a second position.
Figure 4:
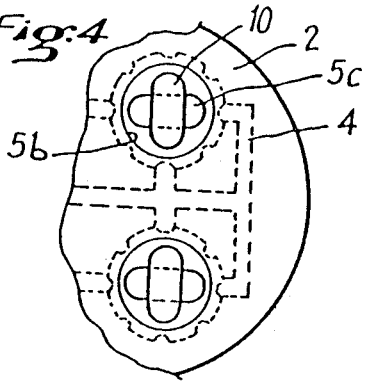
FIG. 4 is a plan view corresponding to FIG. 3.
Figure 7:
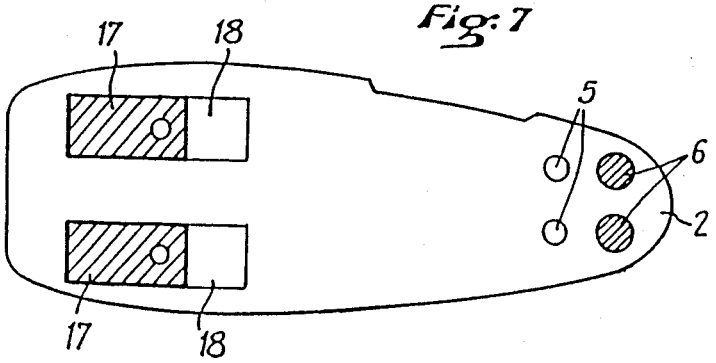
FIGS. 7 to 10 are schematic views showing various possible positions for the front and rear chocks.
Figure 8:
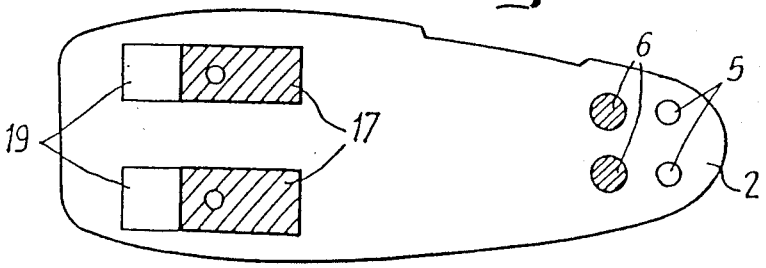
Figure 9:
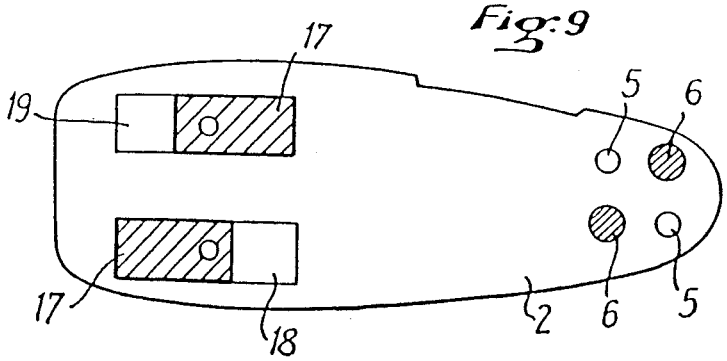
Figure 10:
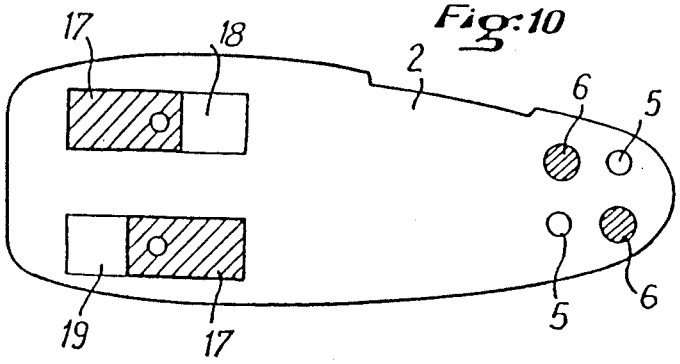

Chock 12 may thus be positioned as shown in FIG. 2, small plate 17 being fitted into recess 19, or, disengaging plate 17 from recess 19 (FIG. 5), chock 12 may be pivoted 180° about an axis perpendicular to sole 2 in order to move plate 17 to widened portion 18, as shown in FIG. 6.

In this manner, it is possible to modify at the same time both the point of contact of chock 12 and the extent to which it projects from under sole 2.

Chocks 6 and 12 are preferably made of plastic, like inner sole 2. They are provided with attachment means (rods 9, 14; bars 10, 15) which are very easy to manipulate, these means being located inside the boot and thus protected from inclement weather conditions.

FIGS. 7 to 10 show four adjustments possible with chocks 6 and 12.

In all of the illustrated examples, sole 2 comprises rear chocks 6 and front chocks 23 of different configuration. It is obvious, however, that the inner sole may be provided with identical rear and front chocks of either type. For example, it would be possible to dispose at the front a plurality of bores analogous to bores 5, disposed in pairs transversely of the axis of sole 2; the latter would then comprise replacements (bores 5) both at the front and rear for chocks analogous to chocks 6 which can be emplaced or removed at will. It would also be possible to replace the four bores 5 shown in FIGS. 1 to 10 by two bores 11, and thus to locate at the rear two chocks identical with chocks 12, each chock being capable of occupying two positions corresponding to two different thicknesses, bores 11 preferably being arranged in pairs transversely of the longitudinal axis of sole 2.

Figure 11:
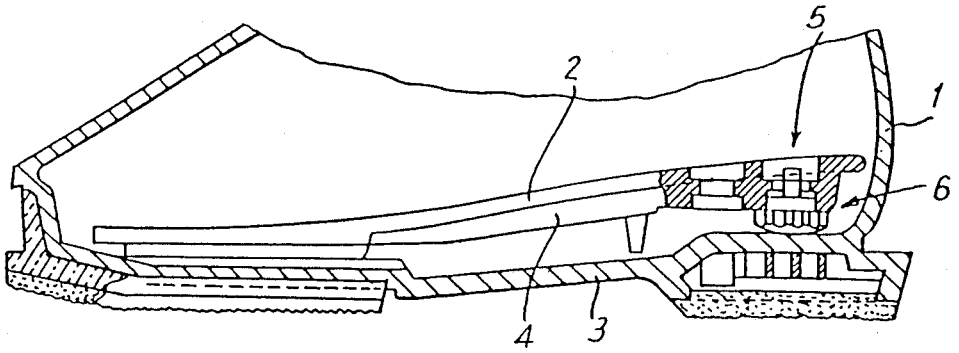
FIGS. 11 and 12 are longitudinal section views of the sole according to the invention.
Figure 12:
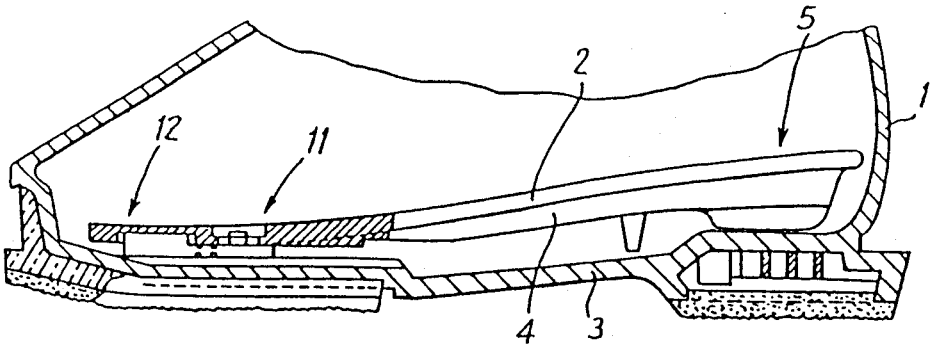

It is also possible for the inner soles 2 to comprise only a single pair of adjustable chocks, which may be disposed either in the heel region, as shown in FIG. 11, or in the metatarsal support region of the foot, as shown in FIG. 12.

In this manner, it is possible to adjust the position of the foot according to a line transverse to the longitudinal axis of sole 2, the other end of the sole (front according to FIG. 11 or rear according to FIG. 12) remaining in unchanged contact with the upper bottom of shell base 1, i.e., the actual boot sole 3.

Figure 13:
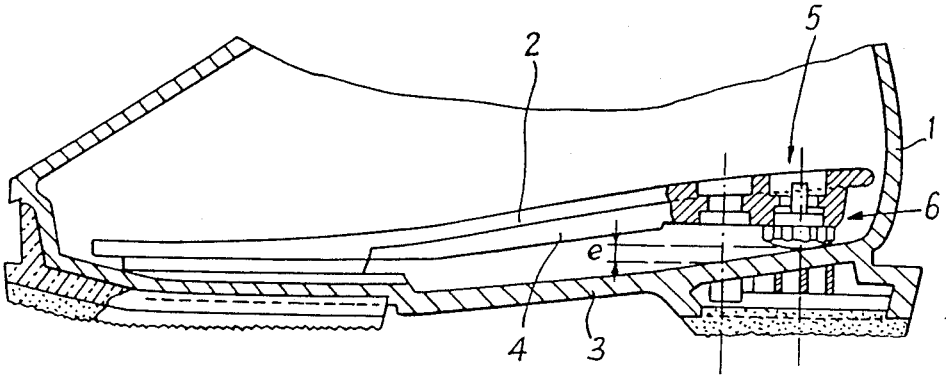
FIG. 13 is a longitudinal section view of a variant of the boot shown in FIGS. 2, 11 and 12.

In FIG. 13, the profile of sole 3 is different from that shown in the examples of FIG. 2, 11 and 12, in which the profile of sole 3 has a break creating a kind of step, inside the boot, at the level of the exterior heel of the boot. According to the embodiment shown in FIG. 13, the slope of sole 3 is continued from the rear of the heel up to the plantar region of the foot. This makes it possible to obtain a height differential equal to e depending on whether chock 6 is in rear or front position.

Figure 14:
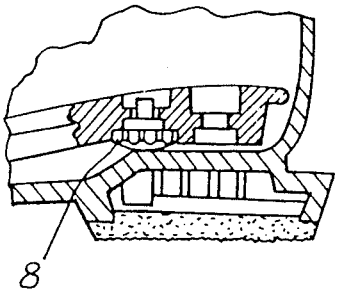
FIG. 14 is a partial longitudinal section view of a variant of the device shown in FIGS. 2, 3 and 11, the rear chock being in its most advanced position.
Figure 15:
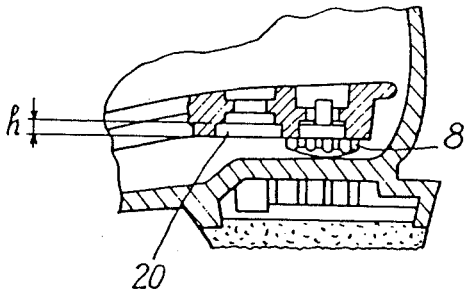
FIG. 15 is a view similar to FIG. 14, with the rear chock in its rearward position.

The embodiment of the sole shown in FIGS. 14 and 15 consists of providing a supplemental aperture 20 at the base of a bore 5, of a diameter equal to or slightly larger than that of element 7, and having a depth h at most equal to the thickness of said element. Thus, in placing the latter into the bore 5 comprising aperture 20, the heel of inner sole 2 is lowered by a height h.

In the example shown in FIGS. 14 and 15, it is the bores 5 which are located at the front which are provided with apertures 20, but this is merely an optional arrangement. It is also not essential for the bores 5 of the same pair to be provided with such aperture, i.e., there may be only one per pair.

What is claimed is:

1. Ski boot of the type comprising an inserted inner sole (2) resting on a sole (3) of said boot (1) through the intermediary of at least one pair of chocks (6; 12) disposed at the level of a front and/or rear region for supporting a foot of a skier wearing said boot, each said chock being attached to a lower face of said inner sole (2) by means enabling it to be emplaced or removed by simple rotation of said chock through 90° about an axis perpendicular to a surface of said inner sole.

2. Ski boot according to claim 1, wherein said inner sole (2) receives a pair of chocks (6) located in the region for supporting the heel of the skier.

3. Ski boot according to claim 1, wherein said inner sole (2) receives a pair of chocks (12) located in the metatarsal support region.

4. Ski boot according to claim 2, wherein said inner sole (2) comprises a plurality of bores (5) each receiving a said chock (6) constituted by a cylindrical element (7) whose axis is perpendicular to said surface of said inner sole, each said element (7) being provided on one end with a knurled knob (8) and on the other end with a transverse bar (10) for attaching said chock to said inner sole through said 90° rotation.

5. Ski boot according to claim 4, wherein each said bore (5) comprises a lower portion (5*a*) receiving said cylindrical element (7) and an upper portion (5*b*) receiving said bar (10), said upper and lower portions communicating through an elongated window (5*c*) having the shape of said bar, wherein the latter, when correctly aligned, is insertable through said window and, after said 90° rotation, is securely housed therein.

6. Ski boot according to claim 5, wherein said bores (5) are disposed in pairs transversely with respect to the longitudinal axis of said inner sole (2).

7. Ski boot according to claim 3, wherein said inner sole (2) comprises a plurality of bores (11) each receiving a chock (12) constituted by a cylindrical rod (14) whose axis is perpendicular to said surface of said inner sole (2), each said rod being fast on one end with an attachment plate (13) to which is articulated a small plate (17) having a thickness e, each said rod being provided at its other end with a transverse bar (15) for attaching said chock (12) to said inner sole by 90° rotation about an axis perpendicular to said inner sole.

8. Ski boot according to claim 7, wherein each said bore (11) comprises an upper portion (11*b*) communicating with an elongated window (11*c*) having the shape of said transverse bar (15), whereby the latter, when correctly aligned, is insertable through said window and, after said 90° rotation, is securely housed therein.

9. Ski boot according to claim 8, wherein said inner sole (2) comprises, on both sides of each bore (11), a widened portion (18) and a recess (19) having a shape corresponding to that of said small plate (17), such that, upon 180° rotation of said shock (12) about the axis of said rod (14), said small plate (17) is displaceable between a position abutting said widened portion (18) and a position in which it is lodged within said recess (19).

10. Ski boot according to claim 9, wherein said bores (11) are disposed in pairs transversely of the longitudinal axis of said inner sole (2).

11. Ski boot according to any one of the preceding claims, wherein said inner sole (2) comprises at its forward portion a pair of chocks at two positions according to any one of claims 7 to 10, and at its rear portion four bores (5) according to any one of claims 4 to 6, in which are located two chocks according to any one of claims 4 to 6.

12. Ski boot according to any one of claims 1 to 10, wherein a rear portion of said boot sole (3) has a continuously sloping profile, whereby a height difference e can be obtained by placement of said chocks at the front or rear region of said boot.

13. Ski boot according to any one of claims 1 to 10, wherein at least one of said bores (5) receiving said chocks (6) comprises at its lower end a portion (20) inside which said knurled knob (8) can be housed.

* * * * *

UNITED STATES PATENT AND TRADEMARK OFFICE

CERTIFICATE OF CORRECTION

PATENT NO. : 4,765,070

DATED : August 23, 1988

INVENTOR(S) : Jean-Pierre Chemello et al.

It is certified that error appears in the above-identified patent and that said Letters Patent is hereby corrected as shown below:

On The Title Page Item [30] insert;

-- March 10, 1986 [FR] France.....86 03336 --.

Signed and Sealed this

Second Day of January, 1990

*Attest:*

JEFFREY M. SAMUELS

*Attesting Officer*

*Acting Commissioner of Patents and Trademarks*